US006868557B1

(12) United States Patent
van der Sleesen

(10) Patent No.: US 6,868,557 B1
(45) Date of Patent: Mar. 22, 2005

(54) GARMENT WITH SUBPANEL VENTILATION ASSEMBLY

(76) Inventor: Michael van der Sleesen, 23 S. Kingman St., Lakeville, MA (US) 02347-1821

( * ) Notice: Subject to any disclaimer, the term of this patent is extended or adjusted under 35 U.S.C. 154(b) by 0 days.

(21) Appl. No.: 10/654,364

(22) Filed: Sep. 3, 2003

(51) Int. Cl.[7] ..... A41D 3/02
(52) U.S. Cl. ..... 2/93; 2/DIG. 1
(58) Field of Search ..... 2/69, 85, 87, 97, 2/93–94, 227–228, 115, 108, 244, 102, DIG. 1, 247, 252, 164, 159, 209.5; D2/839, 857

(56) References Cited

U.S. PATENT DOCUMENTS

| | | | | | |
|---|---|---|---|---|---|
| 1,725,520 | A | * | 8/1929 | Kaplan | 2/209.5 |
| 2,010,434 | A | * | 8/1935 | Langrock | 2/93 |
| 2,073,711 | A | * | 3/1937 | Robinsohn | 2/126 |
| 2,079,980 | A | * | 5/1937 | Anders | 2/115 |
| 2,084,173 | A | * | 6/1937 | Wexler | 2/87 |
| 2,713,168 | A | * | 7/1955 | Bagnato | 2/93 |
| 2,715,226 | A | * | 8/1955 | Weiner | 2/79 |
| 2,716,754 | A | * | 9/1955 | Hirsch | 2/227 |
| 3,045,243 | A | * | 7/1962 | Seymour et al. | 2/1 |
| 3,086,215 | A | * | 4/1963 | Di Paola | 2/93 |
| 3,153,793 | A | * | 10/1964 | Lepore | 2/93 |
| 3,761,962 | A | * | 10/1973 | Myers | 2/79 |
| 3,921,224 | A | * | 11/1975 | Ingram, III | 2/93 |
| 4,513,451 | A | * | 4/1985 | Brown | 2/69 |
| 4,608,715 | A | * | 9/1986 | Miller et al. | 2/1 |
| 4,665,563 | A | * | 5/1987 | Harvey | 2/87 |
| 4,722,099 | A | * | 2/1988 | Kratz | 2/79 |
| 4,731,883 | A | * | 3/1988 | Foster | 2/69 |
| 5,105,477 | A | * | 4/1992 | Golde | 2/93 |
| 5,201,075 | A | * | 4/1993 | Svetich | 2/108 |
| 5,507,042 | A | * | 4/1996 | van der Slessen | 2/69 |
| 5,642,526 | A | * | 7/1997 | Thompson | 2/79 |
| 5,704,064 | A | * | 1/1998 | van der Sleesen | 2/69 |
| 5,727,256 | A | * | 3/1998 | Rudman | 2/115 |
| 5,845,336 | A | * | 12/1998 | Golde | 2/93 |
| D414,913 | S | * | 10/1999 | Katz et al. | D2/829 |
| 6,070,274 | A | * | 6/2000 | van der Sleesen | 2/456 |
| 6,085,353 | A | * | 7/2000 | van der Sleesen | 2/69 |
| 6,125,472 | A | * | 10/2000 | Nakagawa | 2/115 |
| 6,163,883 | A | * | 12/2000 | Hong | 2/69 |
| 6,263,510 | B1 | * | 7/2001 | Bay et al. | 2/93 |
| 6,339,845 | B1 | * | 1/2002 | Burns et al. | 2/243.1 |
| 6,427,242 | B1 | * | 8/2002 | Bush et al. | 2/69 |
| 6,442,760 | B2 | * | 9/2002 | Moretti | 2/115 |

OTHER PUBLICATIONS

Gershman, Maurice, Self–Adhering Nylon Tapes, Journal of the American Medical Association, vol. 168, No. 7, p. 930, Oct. 1958.*

* cited by examiner

*Primary Examiner*—John J. Calvert
*Assistant Examiner*—Alissa L. Hoey
(74) *Attorney, Agent, or Firm*—McDermott Will & Emery LLP

(57) ABSTRACT

A garment with a subpanel ventilation assembly includes an upper air impervious panel having a top edge and a bottom edge, a lower air impervious panel having a top edge and a bottom edge, an air permeable vent panel having a top edge continuously joined with the bottom edge of the upper air impervious panel, and a bottom edge continuously joined with the top edge of the lower air impervious panel, and an air impervious underlay panel underlying and spanning the vent panel. The underlay panel includes peripheral edges affixed to the peripheral edges of the vent panel. The underlay panel includes a slit extending along a vent axis, wherein the slit includes a selectively operable closure assembly extending therealong.

8 Claims, 4 Drawing Sheets

GARMENT WITH SUBPANEL VENTILATION ASSEMBLY

FIELD OF THE INVENTION

The present invention relates to ventilated garments, and, in particular, to garment with subpanel ventilation assembly.

BACKGROUND OF THE INVENTION

When operating fast moving, relatively open vehicles such as motorcycles, bicycles, and some aircraft, the use of protective apparel is important. However, to be useful, protective apparel must be comfortable enough to wear. Many of the garments commonly used for such applications, such as leather suits and jackets, are unacceptably uncomfortable because they provide poor ventilation. Poor ventilation can be a serious problem during warm or moderate weather.

Wearing poorly ventilated protective apparel is uncomfortable on warm days because poor ventilation causes excessive heat buildup. As a result, the wearer may discard the apparel on warm days. Alternatively, the wearer may partially unfasten the front of the garment to provide some ventilation. However, wearing an unfastened garment can be hazardous when traveling at high speed. Air trapped by the opened garment causes billowing or ballooning of the garment and generates unstable forces on the wearer.

Ventilation assemblies for protective garments are known in the art. One type of the prior art garment includes a ventilating assembly having mesh vents at various locations on the garment, particularly at locations requiring little protection, such as the armpits and throat. Air scoops in the garment allow airflow into the mesh vents and through the garment. The garment does not, however, permit the wearer to selectively control the amount and location of ventilation. The prior art ventilating assembly for the garment also is uncomfortable for the wearer, and is hard use for control of ventilation.

It is therefore an object of the present invention to provide a ventilating panel for a garment with an improved ventilation assembly.

It is also an object of the invention to provide a ventilating panel for a garment that offers increased comfort and simplicity of design.

It is a further object of the invention to provide a ventilating panel for a garment with an adjustable ventilating assembly that provides increased ventilation over the body of the wearer.

Other objects and advantages of the present invention will become apparent upon consideration of the appended drawings and description thereof.

SUMMARY OF THE INVENTION

The present invention provides a garment with subpanel ventilation assembly. According to one preferred embodiment of the present invention, the garment panel includes an upper air impervious panel having a top edge and a bottom edge, a lower air impervious panel having a top edge and a bottom edge, an air permeable vent panel having a top edge continuously joined with the bottom edge of the upper air impervious panel, and a bottom edge continuously joined with the top edge of the lower air impervious panel, and an air impervious underlay panel underlying and spanning the vent panel. The underlay panel includes peripheral edges affixed to the peripheral edges of the vent panel. The garment panel is preferably used as a back panel of a jacket, and the side edges of the garment panel are preferably joined to the upper portion of the sleeves and the front panel of the jacket.

The underlay panel further defines a slit extending along a vent axis. A selectively operable closure assembly extends along the slit for selectively opening or closing the slit. In one preferred embodiment, the closure assembly is a zipper with multiple zip heads. In one preferred form, the zipper includes one pair of oppositely directed, facing or non-facing zip heads. In an alternative form, the zipper includes two pairs of oppositely directed, facing or non-facing zip heads. A wearer can adjust the zip heads to control the amount and location of ventilation. In another preferred embodiment, the closure assembly is a hook and loop fastener. A wearer also can adjust the hook and loop fastener to control the amount and location of ventilation.

The panel with the improved air venting assembly can be used with any type of garment, including, for example, pants, vests, leggings, chaps, gloves, and full-body suits.

BRIEF DESCRIPTION OF THE DRAWINGS

For a fuller understanding of the nature and the objects of the invention, reference should be made to the following detailed description and the accompanying drawings in which like reference numerals refer to like elements, and in which.

DETAILED DESCRIPTION OF THE PREFERRED EMBODIMENT

Figure 1:
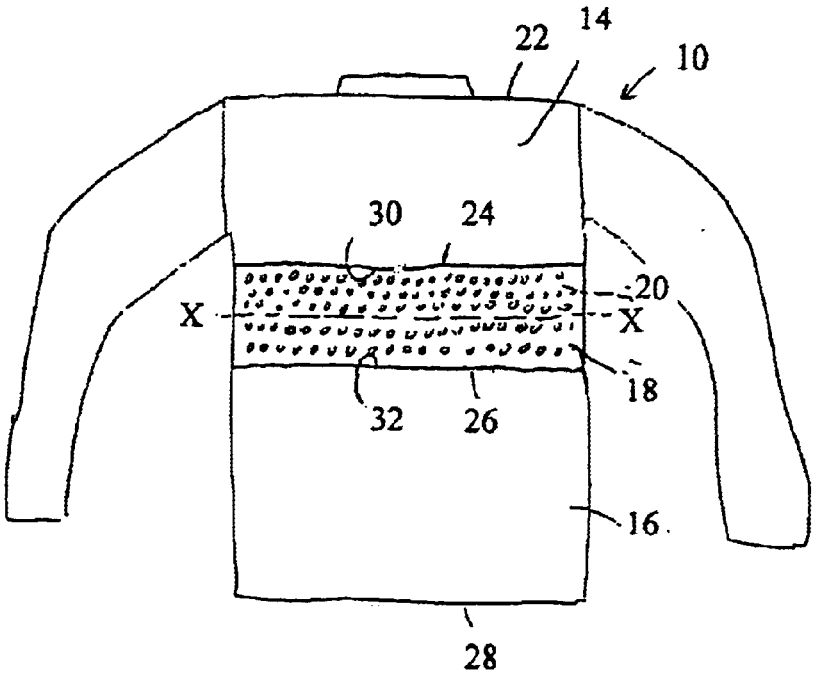
FIG. 1 shows a front schematic view of a garment panel with a ventilating assembly in accordance with one preferred embodiment of the present invention, wherein the panel is used as a back panel of a jacket.

FIG. 1 shows a front view of a panel 12 designed with a ventilating assembly in accordance with the present invention, which is used as a back panel of a jacket. According to one preferred embodiment of the present invention, the panel 12 includes an upper air impervious panel 14, a lower air impervious panel 16, an air permeable vent panel 18 positioned between the upper air impervious panel 14 and the lower air impervious panel 16 and joining the two air impervious panels 14 and 16 together, and an air impervious underlay panel 20 underlying and spanning the vent panel 18.

According to one aspect of the present invention, the upper air impervious panel 14 includes two opposing edges, a top edge 22 and a bottom edge 24. The lower air impervious panel 16 also includes two opposing edges, a top edge 26 and a bottom edge 28. The air permeable vent panel 18 extends along a vent axis X, and also includes a top edge 30 and a bottom edge 32 on either side of the vent axis X. The top edge 30 of the vent panel 18 is continuously joined with the bottom edge 24 of the upper panel 14 by stitches or by other suitable means. The bottom edge 32 of the vent panel 18 is continuously joined to the top edge 26 of the lower panel 16. The vent panel 18 is made of an air permeable material, such as a mesh or otherwise perforated material, which admits air into and out of the garment. The side edges of the panels may either coupled to the upper portion of the sleeves or the front panel of the jacket 10.

Figure 2:
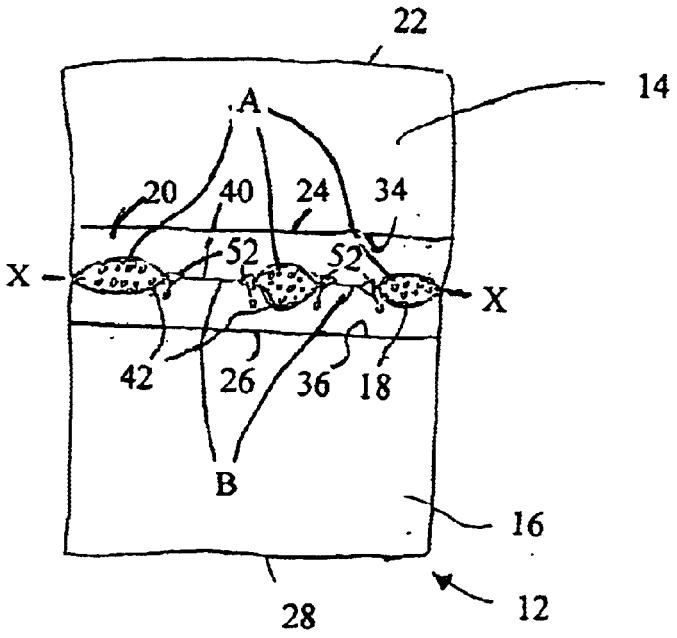
FIG. 2 shows a rear schematic view of a garment panel having a ventilating assembly in accordance with one preferred embodiment of the present invention, with a closure assembly partially opened.

FIG. 2 shows the rear view of the panel 12. As shown in FIG. 2, the air impervious underlay panel 20 underlies and spans the air permeable vent panel 18. The underlay panel 20 also includes a top edge 34 and bottom edge 36 respectively affixed to the top edge 30 and bottom edge 32 of the vent panel. The underlay panel 20 further defines a slit 40 extending along the vent axis X. A selectively operable closure assembly 42 extends along the slit 40 for selectively opening or closing the slit 40.

Figure 4:
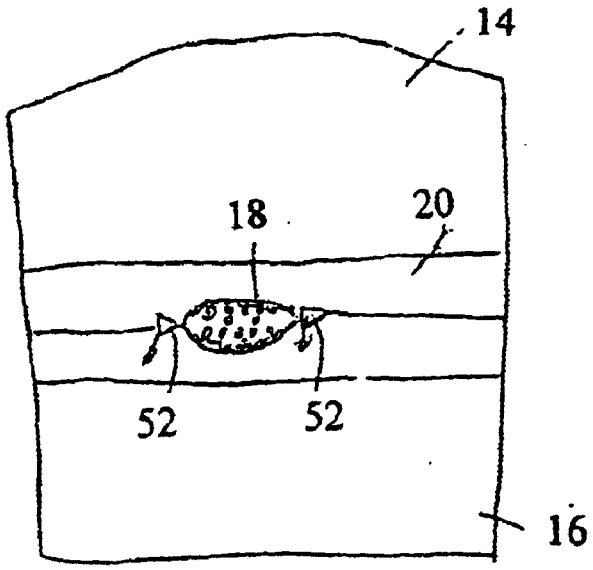
FIG. 4 shows a rear schematic view of a garment panel with a ventilating assembly having a pair of oppositely directed, non-facing zip heads, in accordance with another preferred embodiment of the present invention.
Figure 6:
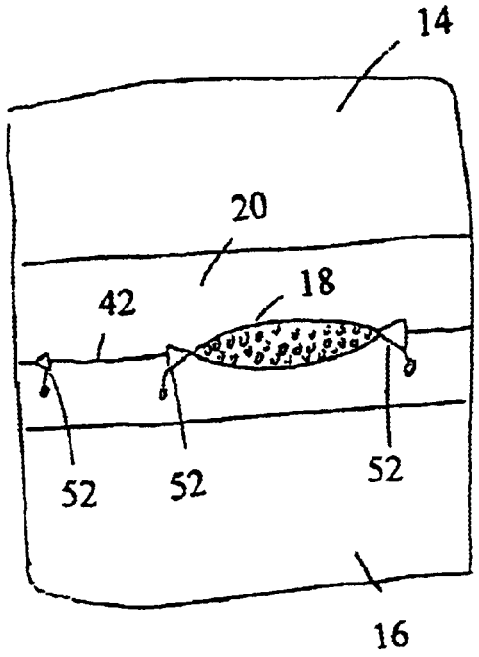
FIG. 6 shows a rear schematic view of a panel with a ventilating assembly having three zip heads, in accordance with a further preferred embodiment of the present invention.

In one preferred embodiment, the closure assembly 42 is a zipper with multiple zip heads, for example, four zip heads as shown in FIG. 2, two zip heads as shown in FIG. 4, and three zip heads as shown in FIG. 6. The zipper can be adjusted to open some part of the slit to admit air in or out of the panel. For instance, when the zip heads 52 are positioned as shown in FIG. 2, portions as denoted by A of the slit 40 are open and the vent panel 18 exposes, forming vent openings, and portions as denoted by B are closed by the zipper. Thus, a wearer can adjust the zip heads to control the amount and location of ventilation.

Figure 3A:
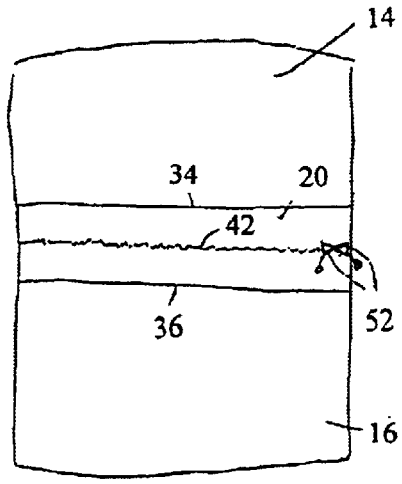
FIG. 3A shows a rear schematic view of a garment panel having a ventilating assembly in accordance with another preferred embodiment of the present invention, showing that the vent opening is completely closed.
Figure 3B:
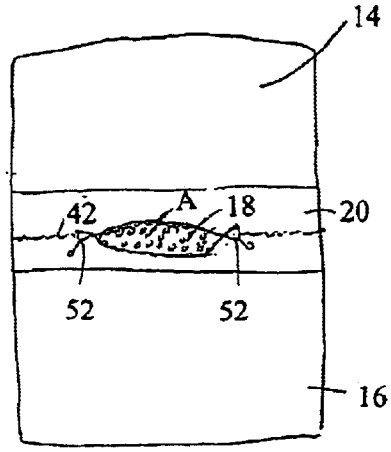
FIG. 3B shows a rear schematic view of a garment panel having a ventilating assembly in accordance with another preferred embodiment of the present invention, showing that the vent opening is partially open.
Figure 3C:
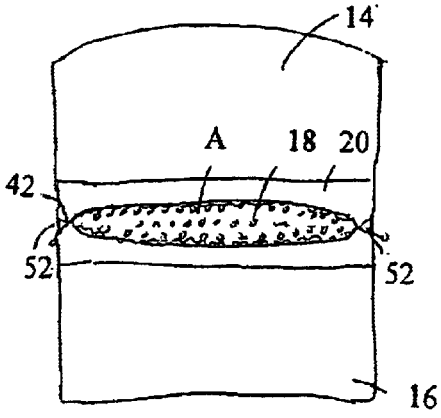
FIG. 3C shows a rear schematic view of a panel having a ventilating assembly in accordance with another preferred embodiment of the present invention, showing that the vent opening is fully open.

FIGS. 3A–3C show another preferred embodiment of the present invention with a pair of oppositely directed, facing zip heads 52. FIG. 3A shows that the two zip heads 52 are positioned at one end of the zipper 42, and the slit 40 is fully closed by the zipper 42. At this time, no ventilation is allowed. FIG. 3B shows that the slit 40 is partially opened by the zipper 42, forming a relative small vent opening A. FIG. 3C shows that the two zip heads 52 are positioned at two ends of the zipper. At this time, the slit 40 is fully opened, forming a relatively large vent opening A.

Figure 5:
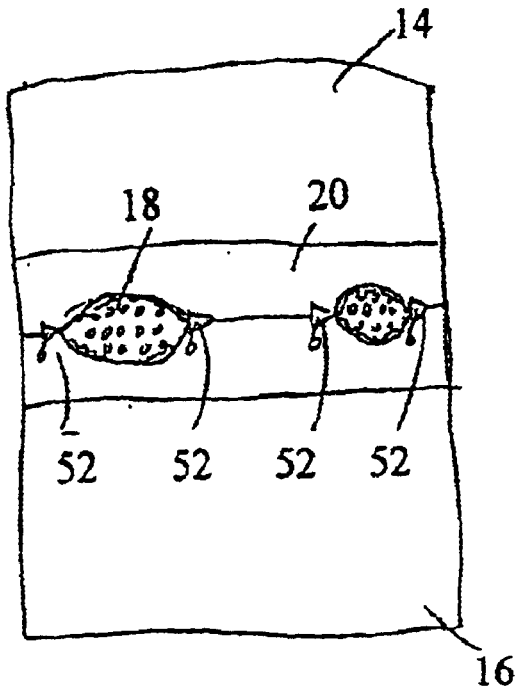
FIG. 5 shows a rear schematic view of a panel with a ventilating assembly having two pairs of oppositely directed, non-facing zip heads, in accordance with a further preferred embodiment of the present invention.

The zipper 42 may include multiple zip heads 52 directed in the same directions, or in opposite directions. FIG. 2 shows a preferred embodiment, in which the zipper 42 includes two pairs of oppositely directed, facing zip heads 52. FIG. 4 shows another preferred embodiment of the present invention, in which the zipper 42 includes a pair of oppositely directed, non-facing zip heads 52. FIG. 5 shows another preferred embodiment, in which the zipper 42 includes two pairs of oppositely directed, non-facing zip heads 52. FIG. 6 shows yet another preferred embodiment of the present invention, in which the zipper 42 includes odd number zip heads, for example, three zip heads.

Figure 7:
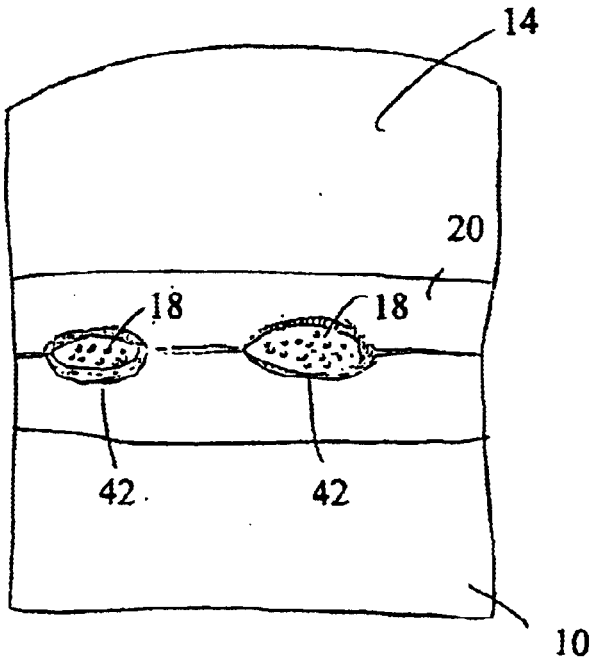
FIG. 7 shows a rear schematic view of a panel with a ventilating assembly having a hook and loop fastener in accordance with a further preferred embodiment of the present invention.

FIG. 7 shows another preferred embodiment of the present invention, in which the closure assembly 42 is a hook and loop fastener. A wearer also can adjust the hook and loop fastener 42 to control the amount and location of ventilation.

The panel with improved air venting assembly described herein is not only able to be used as a back panel of a jacket as illustrated in the figures, but also applicable to any type of garment, including, for example, front panel of a jacket, pants, vests, leggings, chaps, gloves, and full-body suits.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A garment panel comprising:

A. an upper air impervious outer panel having two opposing side edges, a top edge extending between first ends of said side edges, and a bottom edge extending between second ends of said side edges;

B. a lower air impervious outer panel having two opposing side edges, a top edge extending between first ends of said side edges, and a bottom edge extending between second ends of said side edges;

C. an air permeable vent outer panel extending along a vent axis, and having a top edge and a bottom edge opposite thereto on either side of said vent axis, said top edge of said vent panel being continuously joined with said bottom edge of said upper panel, and said bottom edge of said vent panel being continuously joined with said top edge of said lower panel;

D. an air impervious underlay panel underlying and spanning said vent outer panel, and having peripheral edges affixed to said vent panel, and being adapted to be adjacent to the body of a wearer of said garment, and wherein said underlay panel includes a slit extending in the general direction of said vent axis, said slit having a selectively operable closure assembly extending therealong.

2. A garment panel according to claim 1, wherein said closure assembly is a hook and loop fastener.

3. A garment panel according to claim 1, wherein said closure assembly is a zipper.

4. A garment panel according to claim 3, wherein said zipper includes multiple zip heads.

5. A garment panel according to claim 4, wherein said zipper includes a pair of oppositely directed, facing zip heads.

6. A garment panel according to claim 4, wherein said zipper includes a pair of oppositely directed, non-facing zip heads.

7. A garment panel according to claim 4, wherein said zipper includes two pairs of oppositely directed, facing zip heads.

8. A garment panel according to claim 4, wherein said zipper includes two pairs of oppositely directed, non-facing zip heads.

* * * * *